US006176180B1

(12) United States Patent
Taylor et al.

(10) Patent No.: US 6,176,180 B1
(45) **Date of Patent: *Jan. 23, 2001**

(54) LIQUID APPLICATOR FOR CUT SHEETS

(75) Inventors: James E. Taylor, Dallas; Brian M. Bargenquest, Carrollton; Richard W. Carlson, Grapevine, all of TX (US)

(73) Assignee: Dahlgren USA, Inc., Carrollton, TX (US)

( * ) Notice: Under 35 U.S.C. 154(b), the term of this patent shall be extended for 0 days.

This patent is subject to a terminal disclaimer.

(21) Appl. No.: 09/066,963

(22) Filed: Apr. 27, 1998

Related U.S. Application Data

(63) Continuation of application No. 08/714,982, filed on Sep. 17, 1996, now Pat. No. 5,797,318.

(51) Int. Cl.[7] ..... B41L 23/00

(52) U.S. Cl. ..... 101/148; 101/232; 101/247; 118/236

(58) Field of Search ..... 101/142, 147, 101/148, 181, 183, 232, 247; 118/236, 242, 261, 262

(56) References Cited

U.S. PATENT DOCUMENTS

| | | | | |
|---|---|---|---|---|
| 3,647,525 | | 3/1972 | Dahlgren . | |
| 5,207,159 | * | 5/1993 | DeMoore et al. | 101/148 |
| 5,582,087 | * | 12/1996 | Crowley et al. | 101/232 |

OTHER PUBLICATIONS

Elementary Fluid Mechanics, John K. Vennard, 4 pages, 1961.

Controlled Moisture Addition to Moving Webs by a Roll System, *Paper Trade Journal*, C. C. Boggus and J. E. Taylor, 5 pages, Sep. 16, 1968.

"Web Rehumidification and Control," *The Journal of the Technical Association of the Pulp and Paper Industry*, Harry J. Karakourtis, 8 pages, Jul. 1972.

"*Laminator Adds Metallizing to the Mix*, " Paper Film Foil Converter, 2 pages, Sep. 1996.

Brochure : "Mini–LA: Liquid Application System", Dahlgren USA, Inc., 1 page.

Brochure: "Liquid Application System", Dahlgren USA, Inc., 4 pages.

Brochure: "Liquid Application System", Dahlgren USA, Inc., 4 pages.

Brochure: Advertising Material, Dahlgren USA, Inc., 8 pages.

Advertising material, Dahlgren USA, Inc., 1 page.

Brochure: "Liquid Application Systems", CMS, Inc., 8 pages.

* cited by examiner

*Primary Examiner*—Ren Yan
(74) *Attorney, Agent, or Firm*—Carr & Storm, L.L.P.

(57) ABSTRACT

There is disclosed a liquid application system for the printing, copying, imaging, converting, and related industries, and more particularly a liquid applicator means for applying moisture and coatings to cut sheets using a system of rolls and controlling surfaces, speeds, pressures, and directions of rotation of same relative to successive sheets passing through the system. In the use of the method and apparatus herein described, the liquid applied to the sheet is supplied from a reservoir or other liquid supply source to the nip between a smooth, resilient surfaced metering roll and a smoothly finished hydrophilic transfer roll. An abundant supply of liquid is supplied at the nip between the rolls which is metered by pressure contact between the resilient surfaced metering roll and the transfer roll to an exactly controlled film which adheres to the surface of the transfer roll, which rotates into contact with a cut sheet to apply the liquid thereto. A backup roll serves to propel the sheet through a pressure nip formed between the transfer roll surface and the surface of the backup roll. Sheet guides and feed rolls carry the sheets to and away from the pressure nip.

53 Claims, 11 Drawing Sheets

LIQUID APPLICATOR FOR CUT SHEETS

CROSS REFERENCE TO RELATED APPLICATIONS

This is a continuation of application Ser. No. 08/714,982, filed Sep. 17, 1996, entitled LIQUID APPLICATOR FOR CUT SHEETS by James E. Taylor, Inventor, now U.S. Pat. No. 5,797,318.

FIELD OF THE INVENTION

This invention generally relates to a liquid application system for offset and document printing, copying, imaging, converting, and related industries, and more particularly for a liquid applicator means for applying moisture and coatings to cut sheets.

BACKGROUND OF THE INVENTION

There have been countless attempts throughout the printing industry to apply and control moisture in paper. Attempts have been made in the past to add liquids such as dyes, low-viscosity coatings and moisture to a moving web in such a manner as to control the liquid application along the length and width of the web. Such attempts have consisted of application of atomized particles in the form of mist, steam or spray to the web which results in only partial coverage of the web by the atomized particles or uneven application thereof and lack of adequate control of the amount and density thereof.

Another system used in the past is by means of rolls wherein an uncontrollable quantity of liquid is applied to the web. Various other devices have been used such as scrapers, knives, blades, etc. as the sole means for controlling the thickness of liquid applied to the web from a roll. Such devices are undesirable because it is difficult to adjust flexible blades lengthwise and because the slightest adjustment of the blade may change the film thickness more than is desirable.

Environmental chambers, wherein a moving web is passed through a humid atmosphere within a chamber, have been unsatisfactory because only surface quantities are added to the web due to the limited time of exposure of the web to the humid atmosphere as it passes through the chamber. As a result, the web does not absorb sufficient quantity of the liquid. Furthermore, one side application is virtually impossible. Control of moisture by varying web speed through drying devices or by varying the drying temperatures and humidity is not only difficult but undesirable and costly.

Applying moisture (humidity) and/or coatings to one or both sides of a cut sheet has been previously impossible, or at least impractical, slow, and expensive, particularly where 100% coverage was required. Consequently, systems to date have been limited to application of moisture to a web of material rather than individual sheets.

SUMMARY OF THE INVENTION

The foregoing and other difficulties are overcome by the present invention, which is capable of controllably moisturizing cut sheets. Liquid applied to a cut sheet is supplied from a reservoir or other liquid supply source to the nip between a metering roll and a hydrophilic transfer roll. An abundant supply of liquid is supplied at the nip between the rolls which is metered by pressure contact between the metering roll and the transfer roll to a liquid film thickness which adheres to the surface of the transfer roll. The transfer roll rotates in contact with and applies liquid to the cut sheet. A backup roll having a resilient surface draws the cut sheet over the transfer roll, at a speed and in a direction desired, preferably in a direction opposite the surface of the transfer roll when moisture is applied. Individual free sheet edges are fed and guided to, through and away from the point of contact of the surfaces of the rolls. The relative speed of the transfer and backup rolls, thickness of the liquid film and pressure applied by the backup roll to the cut sheet can be varied to control the degree of moisturization. Two or more such assemblies may be used to apply liquid to both sides of a cut sheet and to apply a variety of liquid to the sheet.

BRIEF DESCRIPTION OF THE DRAWINGS

The following briefly describes the content of each figure of the drawings to which the detailed description refers.

DETAILED DESCRIPTION OF THE INVENTION

Figure 1:
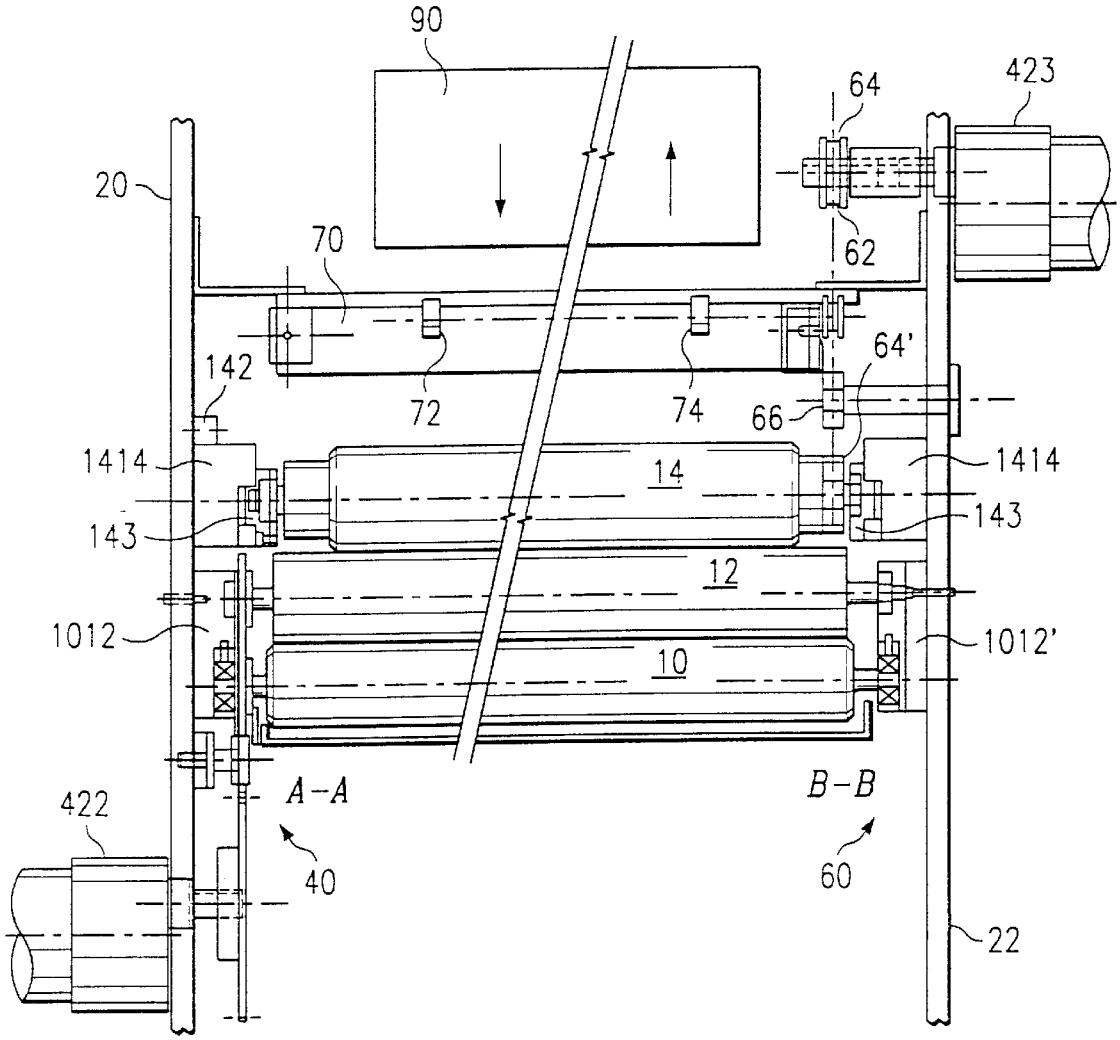
FIG. 1 is a top elevational view of a metering roll, transfer roll, and backup roll of an assembly of the present invention in section showing a gear drive and a belt drive.

Numeral references are employed to indicate the various parts as shown in the drawings and like numerals indicate like parts throughout the various figures of the drawings.

Figure 2:
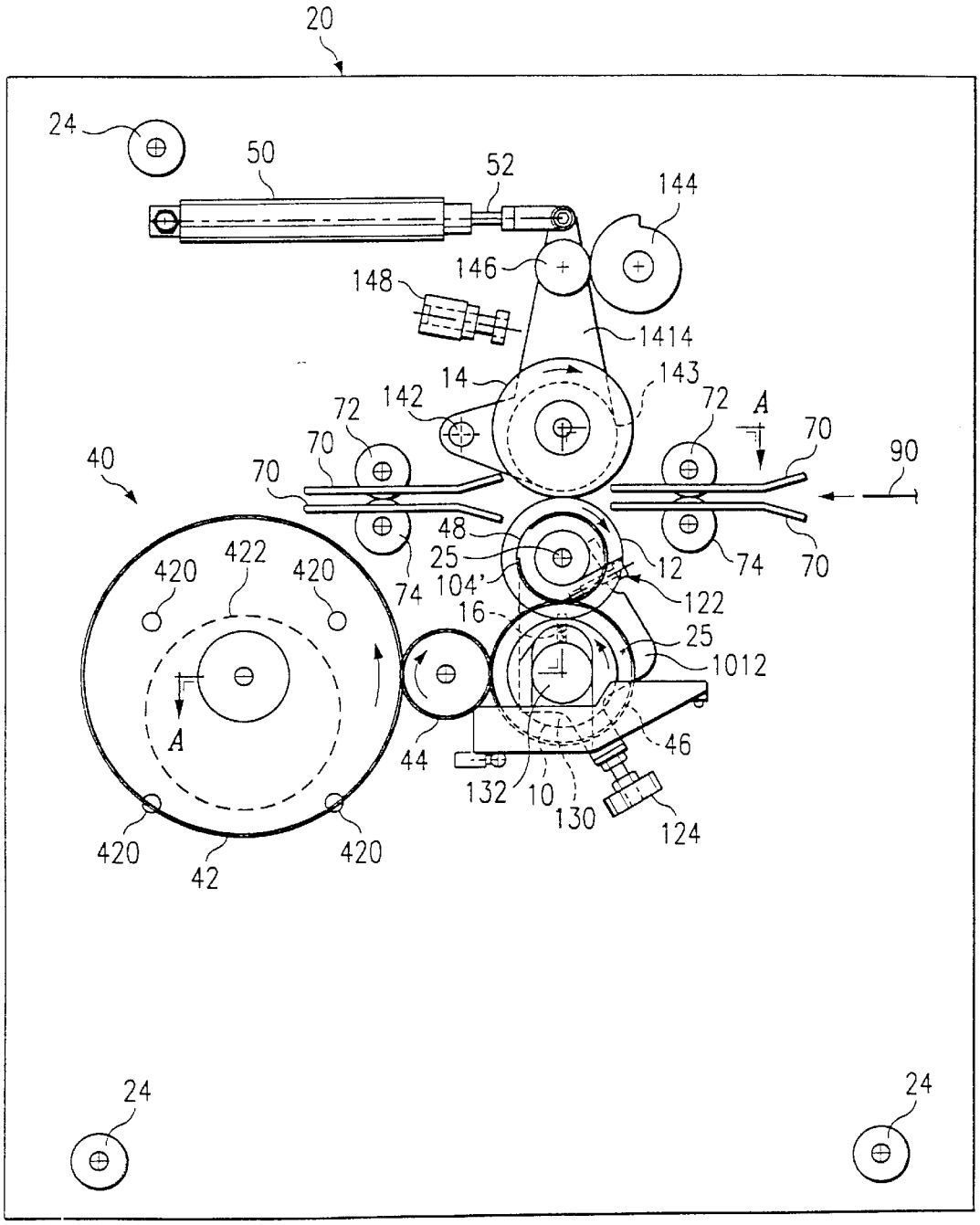
FIG. 2 is a semi-diagrammatic side view showing the interconnection of the gear drive, transfer roll and metering rolls corresponding to Section A—A of FIG. 1.

FIG. 1 is a top elevational view, in section, of a metering roll 10, transfer roll 12, and backup roll 14 of an assembly of the present invention held within side frames 20 and 22. The term "transfer roll" as used herein means the roll which transfers a metered film of liquid to the sheet regardless of its surface characteristic, and the term "metering roll" means the roll which rotates in pressure contact with the transfer roll to meter a film of liquid thereon. As will be more clearly seen below, side frame 20 of FIG. 2 is connected to side frame 22 of FIG. 3 by a plurality of tie bars 24. FIG. 1 also shows a gear drive 40, that will be discussed in detail as Section A—A in FIG. 2, and a belt drive 60, that will be discussed in detail as Section B—B in FIG. 3.

Transfer roll 12 is of a specially prepared type which has a hard, smooth surface thereon having minimum surface indentations, scratches, or blemishes thereon and is preferably treated to render same hydrophilic, that is, liquid receptive (water loving) and grease rejecting. The transfer roll 12 may be of the type described in U.S. Pat. No. 3,168,037, which includes a metal roll, such as steel, which is plated with a hard-surfacing material such as chrome and is polished by buffing or otherwise to provide a smooth uninterrupted surface thereon free of surface blemishes, insofar as possible.

It will be understood that the surface of the transfer roll 12 may be made of other materials which may be applied thereto with a smooth uninterrupted surface thereon and which may be provided with hydrophilic properties, either when manufactured, applied thereto or which may be treated to render hydrophilic. The chrome plated and ground surface may be treated in the manner described in U.S. Pat. No. 3,168,037, by bathing same with a passivating agent such as hydrochloric acid mixed with water and gum arabic in equal proportions for sufficient length of time to remove all oxide from the surface thereof and applying an oxide preventing coating of gum arabic thereto.

The transfer roll 12 runs in pressure contact with a resilient-surfaced metering roll 10. The metering roll 10 is covered with resilient rubber or plastic material and is arranged to be adjusted in indenting relationship with the transfer roll 12. The metering roll 10 has a smooth, uninterrupted surface thereon.

A backup roll 14 is added to the combination shown in FIG. 1. The backup roll 14 also has a resilient surface, such as rubber or plastic, thereon.

Although roll diameters and lengths may vary according to specific application parameters, rolls shown will readily handle sheet sizes of approximately 5"×8" to 14"×20" with a thickness range of approximately 0.004" to 0.012". Roll diameters and lengths shown are as follows:

Backup roll=2¾" DIA×15½" long

Transfer roll=2¼" DIA×16½ long

Metering roll=2" DIA×16½" long

Feed roll (Upper)=1"DIA×½" long

Feed roll (Lower)=1" DIA×1" long

Referring now to FIG. 2, there is shown a semi-diagrammatic side view illustrating the interconnection of the gears and the rolls that corresponds to Section A—A of FIG. 1. The principal gears shown are drive gear 42, idler gear 44, metering roll gear 46, and transfer roll gear 48. Drive gear 42, which is attached to gear motor 422, is held in place by a plurality of mount screws 420 and is driven by the independently variable speed gear motor 422, thereby turning or driving the other gears in the gear drive system 40.

Metering roll 10, transfer roll 12, and backup roll 14 are also shown in FIG. 2. Metering roll 10 and transfer roll 12 are supported by metering-roll/transfer-roll hanger 1012. Shoulder bolts 25 connect hanger 1012 to side frame 20. Backup roll 14 is supported by eccentrics 143 which are rotatable in backup-roll hanger 1414. Eccentrics 143 serve to align the vertical centerlines of the backup and transfer rolls. Hanger 1414 is not directly bolted to side frame 20 but instead pivots about pivot point 142. Cam 144, which is driven by a servo/stepper motor (not shown), moves cam follower 146, which in turn causes the hanger 1414 to pivot. The interaction between cam 144 and cam follower 146 sets the spacing or clearance between the backup roll 14 and the transfer roll 12. An air cylinder 50 with cylinder rod 52 retracts and acts as a resilient air spring forcing cam follower 146 against cam 144. Adjusting screw 148 serves as an off stop for hanger 1414.

The paper path of the present invention runs between backup roll 14 and transfer roll 12 from right to left, as shown. A sheet of paper is routed through the paper path by upper 72 and lower 74 feed rolls between upper and lower sheet guides 70. Upper feed rolls 72 and backup roll 14 are driven by a common timing belt 62 shown in FIG. 3. These rolls drive the upper surface of sheets 90 by friction from resilient surfaces of feed rolls 72 and backup roll 14.

The pressure increased on sides of the sheet 90 by the transfer roll 12 and backup roll 14 may be adjusted by rotation of cam 144 if desired. However, a clearance between the rolls must be maintained at approximately 0.002" (minimum) when there is sheet absence (gap between the sheets), since it is important that moisture on the transfer roll does not transfer to the backup roll, as the rolls rotate. This clearance of 0.002" is normally set and left alone unless perhaps the sheet thickness changes beyond the 0.004" to 0.012" range shown above. The backup roll 14 is applied to the sheet primarily to cause the liquid to penetrate and be more quickly absorbed by the sheet, but also to frictionally drive the sheet as it passes through the pressure nip between the rolls 12 and 14. As discussed above, the backup roll 14 is preferably arranged to be shifted out of contact with the paper if desired.

The controlled lengthwise liquid film 104' is metered from an abundant supply 104 between the transfer and metering roll and is applied directly to the sheet 90 at a controlled uniform and desired rate by controlling and varying the surface speed of the transfer roll 12 with relation to the adjacent surface speed of the sheet 90. To accomplish this purpose, the transfer roll 12 on which the metered and regulated liquid film 104' is carried is driven by a positive drive means so that its surface speed can be varied as desired, either manually or automatically, to transfer a uniform continuous desired quantity of liquid 104 onto the sheet 90. The surface speed of the transfer roll 12 may be less than, equal to, or greater than the surface speed of the adjacent sheet 90, depending upon the liquid 104 and quantity of same desired for the sheet 90.

The metering roll 10 may be driven by the transfer roll 12 or by a variable speed positive control. The surface pressure between the metering 10 and transfer rolls 12 and the speeds of rotation thereof may be adjusted to supply the desired metered film of liquid to produce a continuous metered liquid film 104' on the transfer roll 12 surface.

Where the liquid 104 must immediately penetrate the sheet 90 or where higher quantities of liquid 104 are added, or where the sheet 90 must be pressed firmly against the transfer roll 12 for any reason, a backup roll 14 having a resilient surface is driven at sheet speed and is applied to the opposite side of the sheet 90 from the transfer roll 12 to press the sheet 90 there against at such point, to thereby cause the liquid film 104' to penetrate or adhere to the surface of the sheet 90. Uniform pressure between the sheet 90 and the transfer roll 12 is imperative over the entire sheet as sheets progress between the rolls.

In cases where moisture is to be applied, the transfer rolls' surface moves in a direction opposite to that of the adjacent sheet travel, wherein the sheet 90 is driven by the backup rolls' surface through the nip between the rolls. The transfer roll surface speed is generally faster than sheet speed. Where more viscous materials and coatings are applied, the transfer rolls' surface moves in a direction the same as that of the adjacent sheet travel and generally nearer to that of the sheet 90.

The pressure relationship between the surfaces of the transfer roll 12 and the metering roll 10 may be adjusted by a screw 124 which threadedly extends through the end of hanger 1012. This hanger is secured to side frame 20 of the machine as previously stated. The inner end of the screw 124 extends through threads in an extension 130 of hanger 1012 in which a self-aligning bearing 132 is mounted.

A spring 16 is interposed between the bearing 132 and a slot in hanger 1012 so that as the screw 124 is threaded inwardly, the metering roll 10 is moved toward the transfer roll 12 to increase the pressure between the surface of the metering roll 10 and the transfer roll 12 and at the same time bearing 132 contracts the spring 16. The spring 16 causes the roll 10 to be resiliently urged against the screw 124 so that the roll 10 in effect is stabilized with relation to the transfer roll 12. One end of the hanger 1012 supporting the transfer roll 12 serves as a pivot to one end of the hanger 1012 supporting the metering roll 10.

This arrangement permits one end of the metering roll 10 to be arcuately rotated to a fixed position about the transfer roll 12 to thereby cause the resilient surface of the metering roll 10 to be spiralled about the surface of the transfer roll 12 to thereby distribute pressure between the contacting surfaces of the rolls 10 and 12 to thereby provide for uniform pressure as desired between the ends of the rolls 10 and 12. The ends of the axle of roll 10 are, as mentioned above, mounted in self-aligning bearings 132. Therefore, a fixed skewed position can be built into the machine by locating shoulder bolt 25' (FIG. 3) in frame 22 such that hangar 1012' is pivoted slightly about bolt 25 at the center of the transfer roll. Skew of the metering roll therefore compensates for deflection of the rolls providing a uniform pressure along the rolls length and resulting uniform liquid film thickness. By self-aligning bearing is meant a bearing mounted so that the support therefore (the outer bearing race) will rotate in relation to the axis of the shaft and inner race which it supports. Such bearings are of conventional construction.

Figure 3:
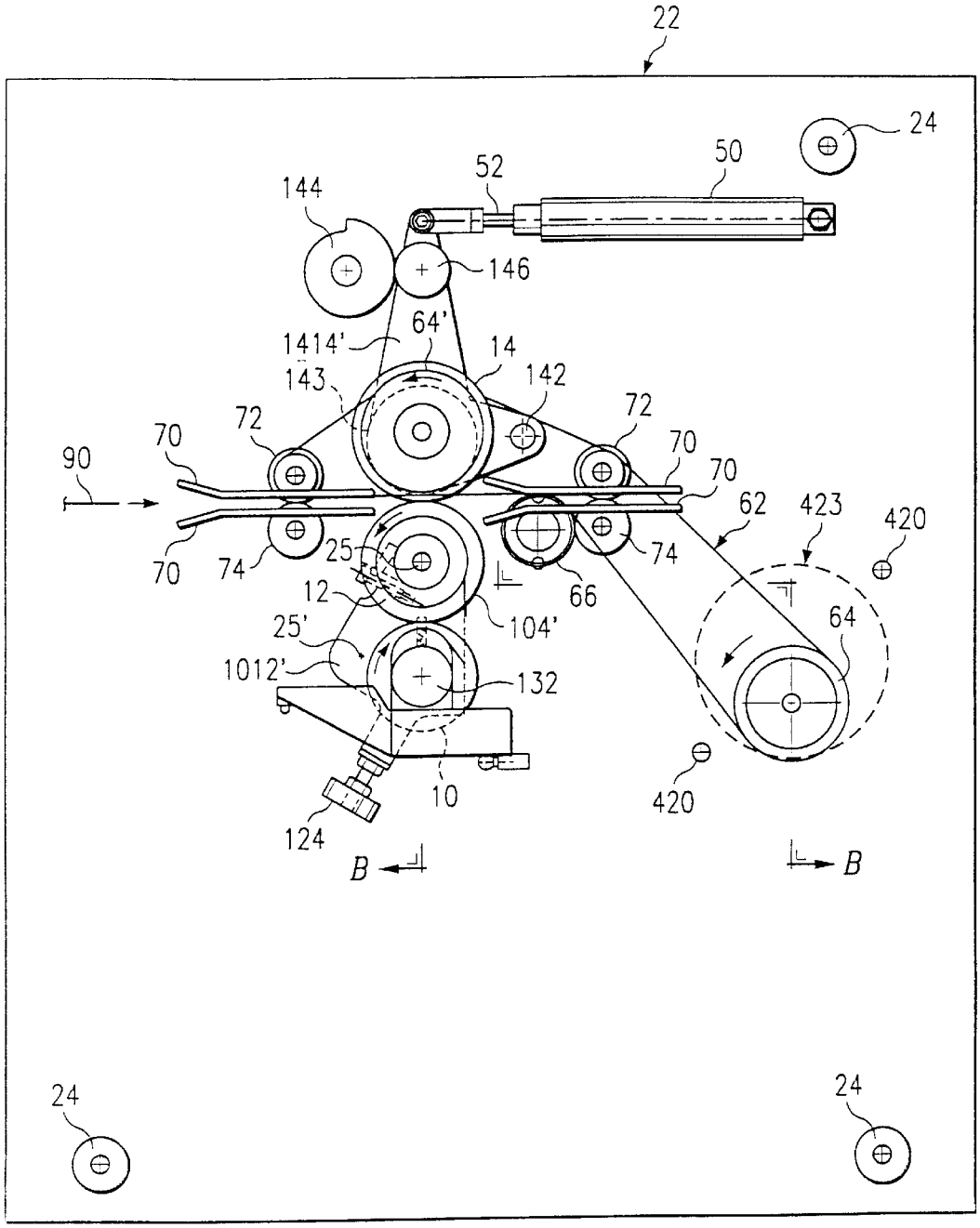
FIG. 3 is a semi-diagrammatic side view of the opposite side showing the interconnection of the belt drive, feed roll and backup roll corresponding to Section B—B of FIG. 1.

In a similar fashion, FIG. 3 is a semi-diagrammatic side view of the opposite side showing the interconnection of the belt and rolls that corresponds to the belt drive 60 indicated by Section B—B of FIG. 1.

The backup roll 14 is rotated by an electric gear motor 423 which is supplied by power through power leads (not shown) and the speed of the gear motor 423 may be regulated by a rheostat. The backup roll 14 is driven by the gear motor 423 through a timing belt 62 which extends about the pulley 64 attached to the shaft of the motor 423 and about pulley 64' mounted on the end of the roll 14. Idler 66 serves to maintain tension on belt 62. In its general use, the backup roll 14 surface, along with the surface of the feed rolls 72, are synchronized and rotated at line or sheet speed of approximately 100 feet per minute. The transfer roll 12 is driven by the independent variable speed drive previously mentioned above and the metering roll 10 is geared to the transfer roll 12 whose surface speed is less than the transfer roll 12 surface speed. For moisturizing, the surface speed of the transfer roll is normally 2 to 4 times the surface speed of the sheet.

Figure 4B:
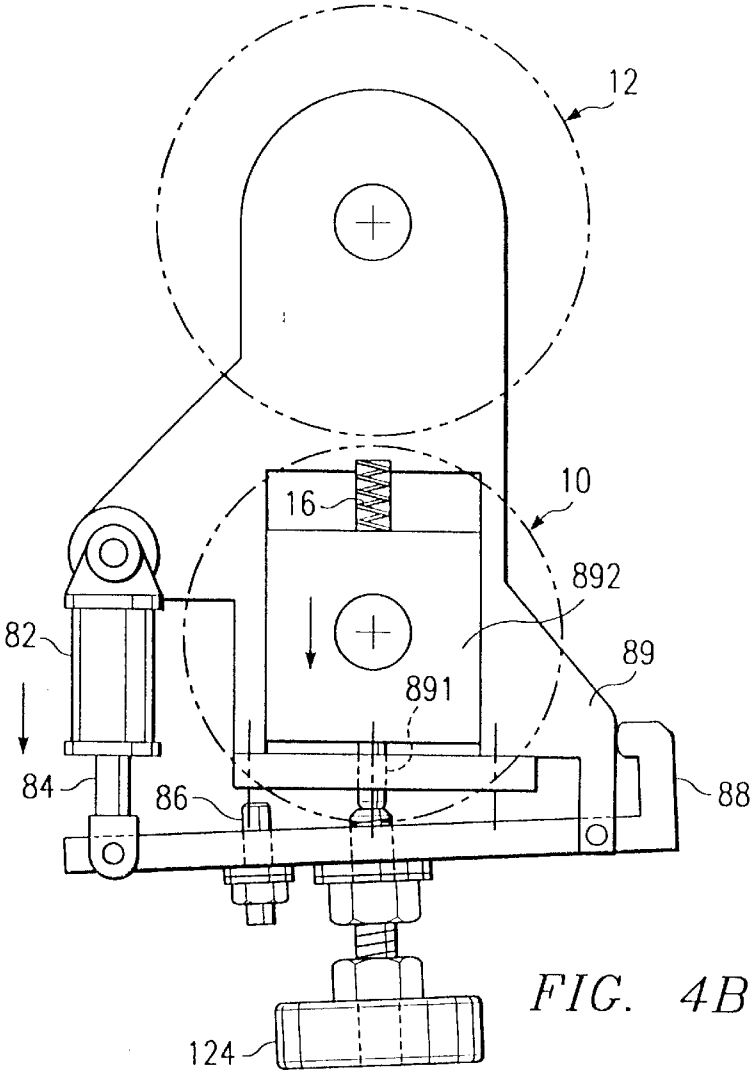
FIG. 4B is a semi-diagrammatic side view of an air-actuated latch showing the metering roll separated from the transfer roll in the "off" position.
Figure 4A:
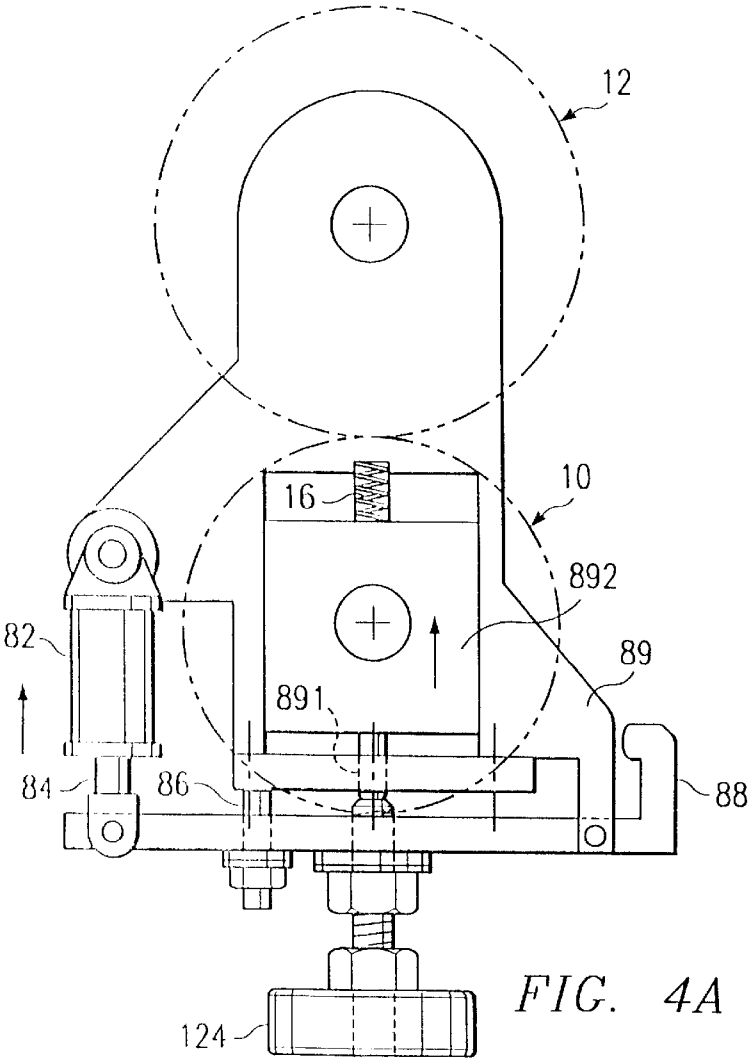
FIG. 4A is a semi-diagrammatic side view of an air-actuated latch showing the metering roll contacting the transfer roll in the "on" position.

FIG. 4A is a semi-diagrammatic side view of an optional air-actuated latch showing the metering roll 10 contacting the transfer roll 12 in the "on" position and showing the metering roll 10 separated from the transfer roll 12 in the "off" position in FIG. 4B. To extend the life of the machine embodying this invention, it is preferable to separate the metering roll 10 away from the transfer roll 12 while not in use, typically overnight.

In these figures, a cylinder rod 84 extends from a cylinder 82 (the "off" position) such that an end of lever 88 is pressed against the side of a hanger 89. A plunger 891 extends to meet the adjustable metering-roll screw 124. Conversely, in the "on" position, the cylinder rod 84 retracts causing the stop 86 to close and the end of lever 88 to no longer press against the side of the hanger 89. Plunger 891 is then depressed, moving the metering roll bearing block 892 to the "on" position.

Figure 5A:
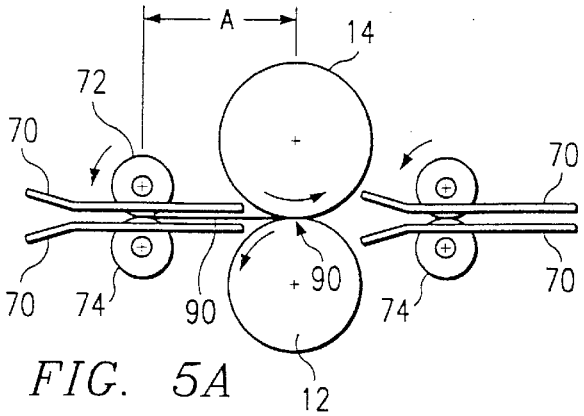
FIG. 5A is a semi-diagrammatic side view showing sheet progression to the backup roll and transfer roll nip.
Figure 5B:
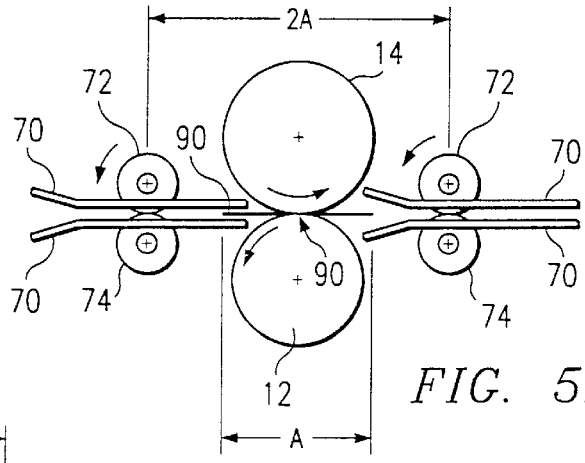
FIG. 5B is a semi-diagrammatic side view showing sheet progression thru the backup roll and transfer roll nip.
Figure 5C:
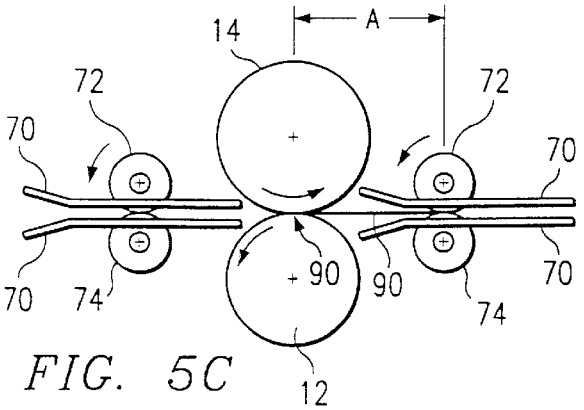
FIG. 5C is a semi-diagrammatic side view showing sheet progression away from the backup roll and transfer roll nip.

FIGS. 5A, 5B, and 5C are semi-diagrammatic side views showing sheet progression substantially straight to, thru, and away from the backup roll 14 and the transfer roll 12 nip, respectively. The distance A between the center line of the backup roll 14 and that of the upper feed rolls 72 is less than or equal to the minimum sheet width. The distance between feed rolls across the width of the device is less than or equal to the minimum sheet length. Sheets are fed such that the length of the sheet coincides with the length of the rolls 10, 12, and 14, that is, the long edges of the sheets become the leading and trailing edges as sheets pass through the system. An exception to this is the 14" by 20" sheet size, where the narrow edges become leading and trailing edges.

Figure 5D:
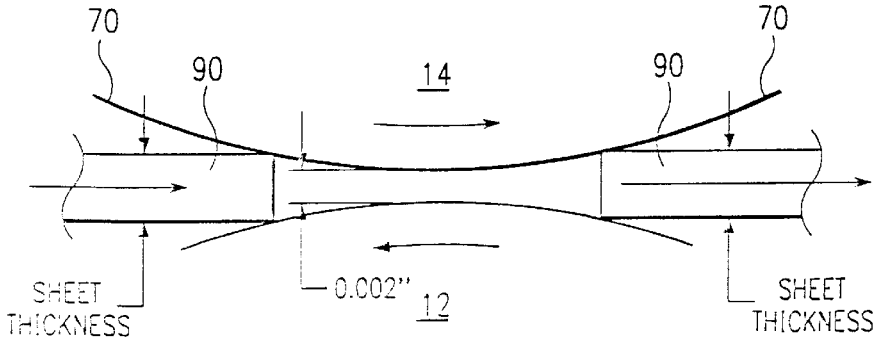
FIG. 5D is a detailed view of FIGS. 5A and 5C.

FIG. 5D is a detailed view of FIGS. 5A and 5C showing a preset minimum gap between the backup roll 14 and the transfer roll 12 of 0.002 inches. In its usual application, the thickness of the sheet substrate 90 is approximately 0.004 inches.

Figure 5E:
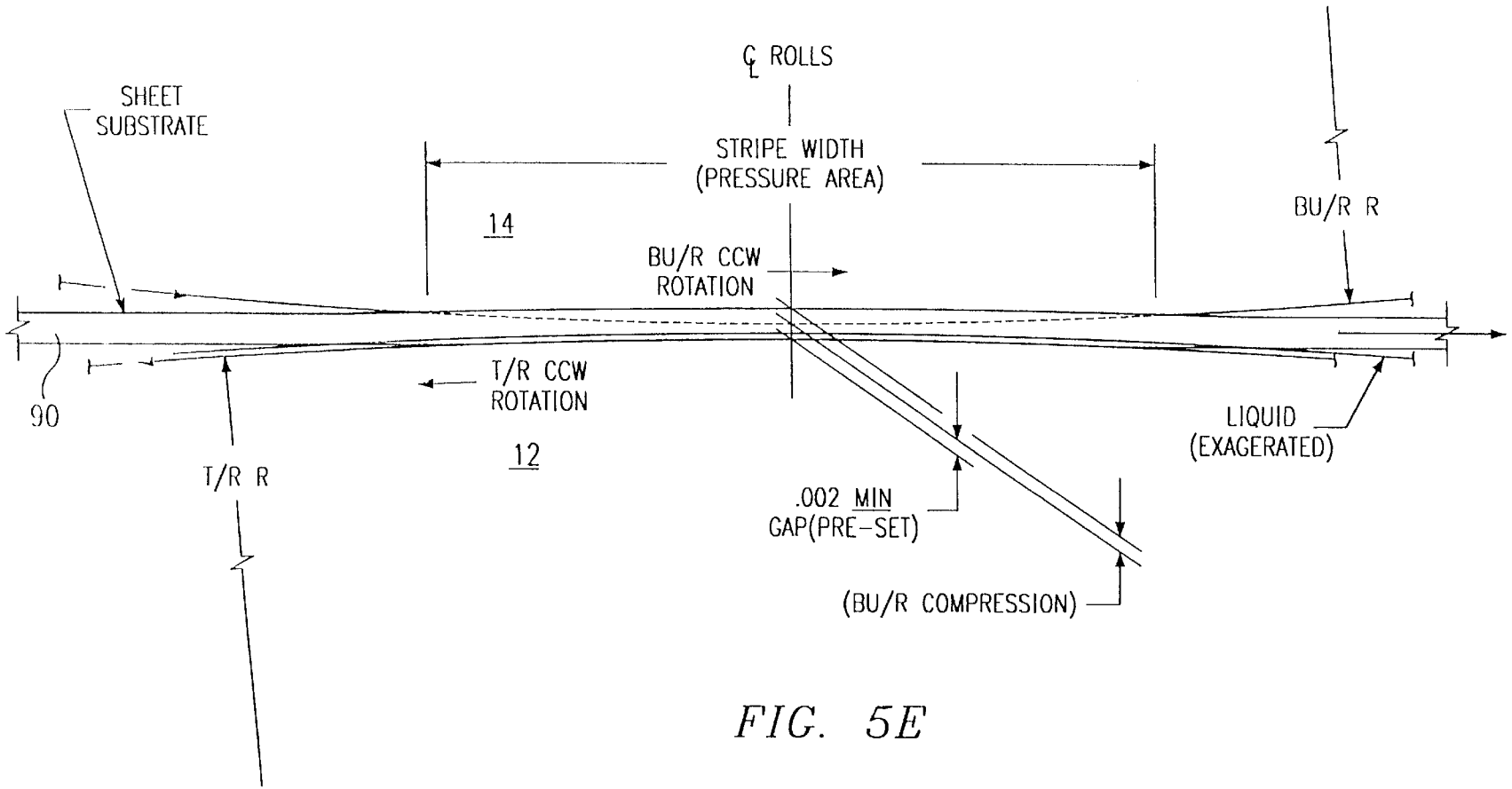
FIG. 5E is an enlarged and detailed view of FIG. 5B.

FIG. 5E is a an enlarged detailed view of FIG. 5B showing the sheet 90 between the backup roll 14 and the transfer roll 12. This figure also shows how the adjacent roll surfaces move in opposite directions. That is, the backup roll is moving in a counter clockwise rotation and the transfer roll 12 is also moving in a counter clockwise direction. Other notations show the area of pressure between the rolls of approximately 3⁄32 inches with resulting backup roll compression, pre-set gap between the rolls, exaggerated liquid film thickness, etc.

Figure 6:
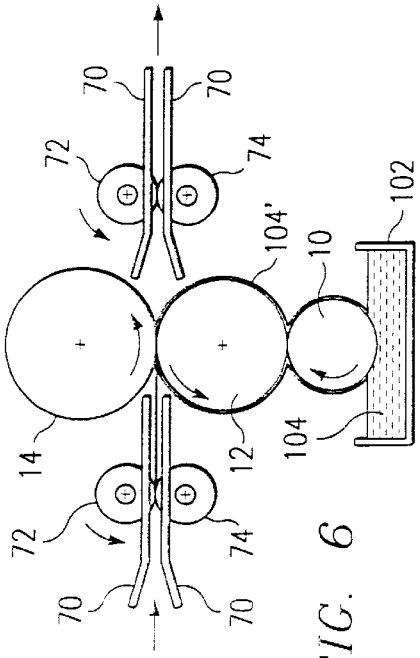
FIG. 6 is a semi-diagrammatic side view showing a liquid applicator device for cut sheets in relationship to the metering roll, transfer roll, and backup roll.

FIG. 6 is a semi-diagrammatic side view showing the liquid applicator device for cut sheets in relationship to the metering roll 10, transfer roll 12, and backup roll 14. The numeral 102 indicates a liquid container or pan with a quantity of liquid 104 therein, while 104' indicates the metered liquid film. The liquid 104 may be moistening fluid such as water with other ingredients added thereto, such as material to lower the surface tension of the water, or it may be other low to medium viscosity coating materials to be added to the sheets 90. For moisturizing and water-like liquids, the transfer roll rotates as shown against the direction of the flow of the sheet. For coatings, the transfer roll rotates with the sheet. Roll directions are shown as broken (dotted) lines.

The metering roll 10 is rotated with the lower side thereof submerged in the liquid 104 so that liquid is picked up on the resilient surface thereof as it rotates therethrough. As liquid 104 is picked up from the container 102 on the surface of the metering roll 10 it is transferred to the hydrophilic transfer roll 12 and then carried on the surface of the roll 12 to the nip between the transfer roll 12 and the backup roll 14. Such liquid forms as an abundant supply on one side of the nip but is sheared and compressed between the contacting surfaces between rolls 10 and 12 and is metered in a uniform, evenly distributed film of liquid 104' onto the surface of transfer roll 12. Such metered uniform film 104' is carried on the surface of the transfer roll 12 to the contacting surfaces between the transfer roll 12 and the sheet 90 and a portion thereof is thus transferred from the transfer roll 12 to the sheet 90.

As hereinbefore explained, the speed of rotation of the transfer roll 12 may be regulated by a rheostat (not shown) to thereby transfer the required amount of liquid to the surface of the sheet 90 in the manner and purpose as hereinbefore described.

By adjustment of the screw 124 the thickness of the abundant quantity of liquid carried on the surface of the metering roll 10 is metered uniformly onto the transfer roll 12 to the sheet 90. Any excess liquid will fall back into pan 102. Normally, the film metered onto the roll 12 will be constant after setting, and the application of liquid to the sheet 90 will be controlled primarily by the adjustment of the speed of rotation of the transfer roll 12.

Preferred roll materials, hardnesses, and surfaces, etc. are shown below:

| Item # | Item Name | Material | Hardness | Surface Finish | Thickness |
|---|---|---|---|---|---|
| 14 | Backup roll | Buna-N Rubber | 50 Durometer | RMS 30 | ¼" |
| 12 | Transfer roll | Chrome-plated Steel | Rc 70 | RMS 4 (Max.) | .007" |
| 10 | Metering roll | Buna-N Rubber | 25 Durometer | RMS 30 | ⅜" |
| 72 | Feed roll (upper) | Buna-N Rubber | 30 Durometer | RMS 30 | ¼" |
| 74 | Feed roll (lower) | Buna-N Rubber | 90 Durometer | RMS 15 | ¼" |

Figure 7:
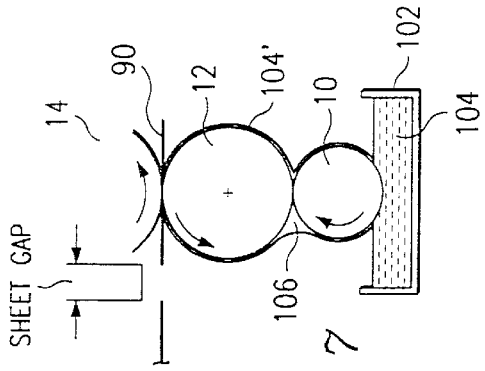
FIG. 7 is a detailed view of the transfer roll ally showing functions during roll rotation.

FIG. 7 is a detailed view of the transfer roll 12 graphically showing functions during roll rotation. The surface of the transfer roll 12 rotates in contact with the metering roll 10 and sheets 90 to apply liquid thereto. The sheets 90 may be paper or board to which moisture is to be added, or they may be individual sheets of fabric or solid materials such as plastic or metal. Water-base and other coatings and liquids such as starch, glue, or other such materials may also be added.

The film of liquid is made constantly present between the hydrophilic surface of the transfer roll 12 and the sheet 90, with the speed differential therebetween producing hydrodynamic forces such that the liquid both penetrates and lifts the sheet. The unused film of liquid provides a lubricating fluid reducing friction between the surface of the transfer roll 12 and the sheet 90. This permits the transfer roll 12 to be rotated at a different surface speed than that of the sheets 90 to thereby permit slipping between said surfaces without frictional damage even when opposing surfaces of transfer roll 12 and sheet 90 move opposite to each other. All unused amounts of liquid film 104' not accepted by the sheets 90 returns to the abundant supply 106 and pan 102 where it is metered to a continuous uniform film for application to subsequent sheets.

Figure 8:
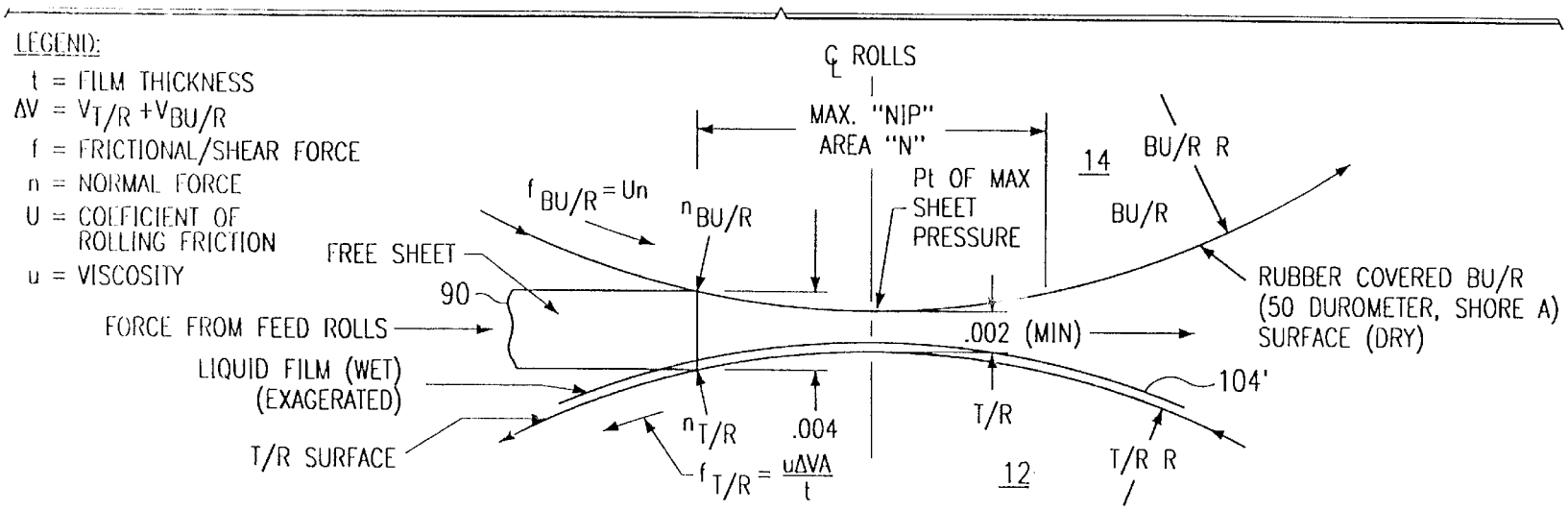
FIG. 8 is a semi-diagrammatic side view showing the free body forces at the point of sheet entrance into the nip between the backup roll and transfer roll.

FIG. 8 is a semi-diagrammatic side view showing the free body forces at the point of sheet entrance into the nip between the backup roll 14 and the transfer roll 12. While not wishing to be constrained by theory, as an individual sheet is guided and fed to the nip between the dry 50 durometer resilient rubber backup roll and the wet liquid water film on the hydrophilic transfer roll, the total normal force, $f_{BU/R}$, from the backup roll increases until the lead edge of the sheet reaches the exit point. The shear force, $f_{BU/R}$, of the backup roll results from multiplying the total $n_{BU/R}$ times the coefficient of rolling friction, U, between rubber and paper which is quite high. Force, $f_{BU/R}$, plus any force from the feed rolls, is therefore high.

At the same instant that force, $f_{BU/R}$, takes place at the top of the sheets' leading edge, force, $f_{T/R}$, is acting in an opposite direction to $f_{BU/R}$ at the bottom of the sheets' leading edge. Force, $f_{T/R}$, results from multiplying the viscosity of water u times ΔV, times the area "N" and dividing this product by film thickness t. Force, $f_{T/R}$, obviously is quite low as compared to the force from the feed rolls plus $f_{BU/R}$, since sheets enter without buckling or kick-back. And as sheets progress through the nip, $f_{BU/R}$ is always greater than $f_{T/R}$, which is most important. The shear stress $$u\frac{v}{h} \quad \text{or} \quad \frac{u\Delta V}{t}$$

is an established formula used in fluids applications. Note that both formulas $f_{BU/R}=Un_{BU/R}$, and $f_{T/R}=$ $$f_{T/R} = \frac{u\Delta V(Area\text{"}N\text{"})}{t},$$

are independent of pressure and that the only variables in both equations are n and "N," respectively, which both increase linearly and simultaneously as sheets progress through the nip.

Figure 9A:
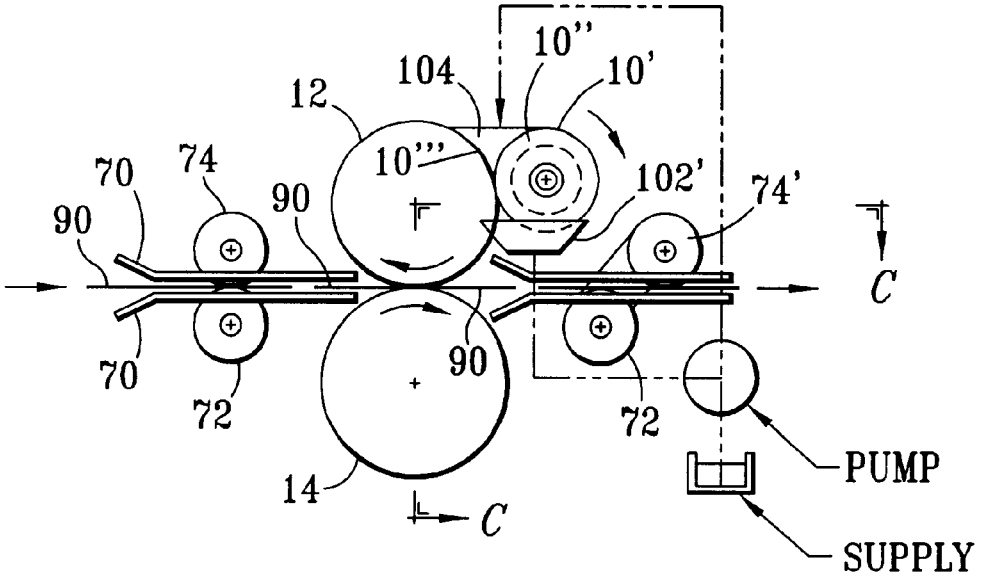
FIGS. 9A and 9B show applications of liquids, moisture and coating, respectively, whereby the liquid is applied to the top surface of the sheets in lieu of the bottom surface of the sheets as shown in the previous figures.
Figure 9B:
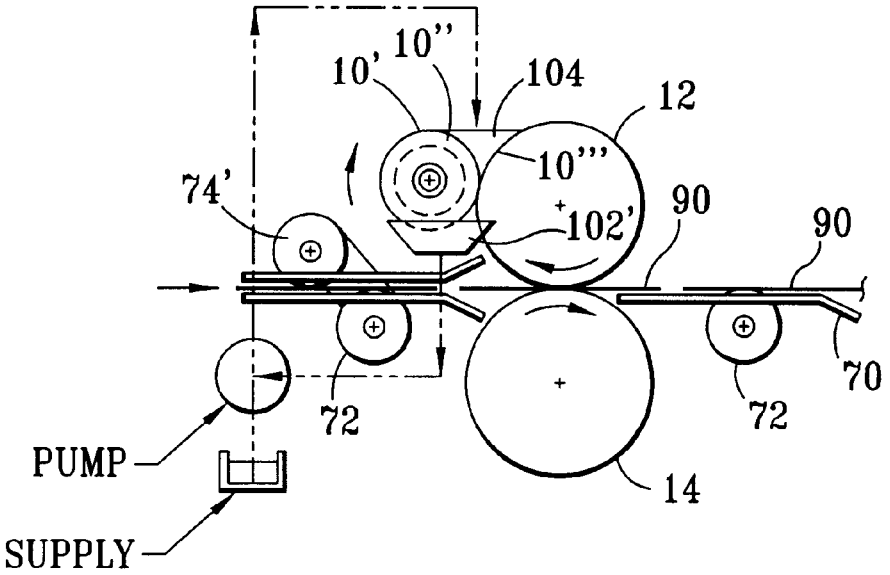

FIGS. 9A and 9B show applications of liquids, moisture and coating, respectively, whereby the liquid is applied to the top surface of the sheets 90 in lieu of the bottom surface of the sheets 90 as shown in the previous figures. While metering roll 10' and transfer roll 12 is above the sheet 90, backup roll 14 is below the sheet as shown.

One or two sided application of liquid 104 may be accomplished by modifying and placing a device immediately upstream or downstream of the first device such that the transfer 12 and metering 10 rolls are above the sheet 90 with the backup roll 14 below the sheet 90 for application to the top surface. When a device is not to be used for applying liquid, it still may be partially used for continuing to propel the sheet 90 through the device. In this case, the transfer roll motor will drive the transfer roll 12 at sheet speed and in the same direction. The metering roll 10 must be separated from the transfer roll 12 to allow the transfer roll 12 to run dry. Friction between adjacent rolls and the sheet 90 will propel the sheet 90 through the device.

Liquid 104 (water or coating) is pumped from a supply to the cusp formed by metering roll 10' and transfer roll 12. Liquid is contained at opposite ends of the cusp by end dams 10" forming face seals on smooth faces of metering roll ends 10' and radial seals 10'" bonded to end dam 10". Radial seal 10'" is curved to match the outside diameter of transfer roll 12. Seal 10'" is made from an elastomeric material to compress when metering roll 10' is adjusted to transfer roll 12.

A catch pan 102' is mounted below the cusp area to catch the liquid 104 as it cascades through a notch formed in end dams 10" at opposite ends of the metering roll 10'. Liquid 104 drains from the catch pan 102' to the pump where it mixes with fresh liquid drawn from the supply and is circulated to the cusp. End dam 10" is fitted with a bushing which serves to locate the dam about the journals of metering roll 10'. Feed roll 74' is made from a large and small pulley and short timing belt as shown. Feed roll 74' is designed to allow space for the pan 102' above sheet guide 70 and below metering roll 10'.

Figure 10:
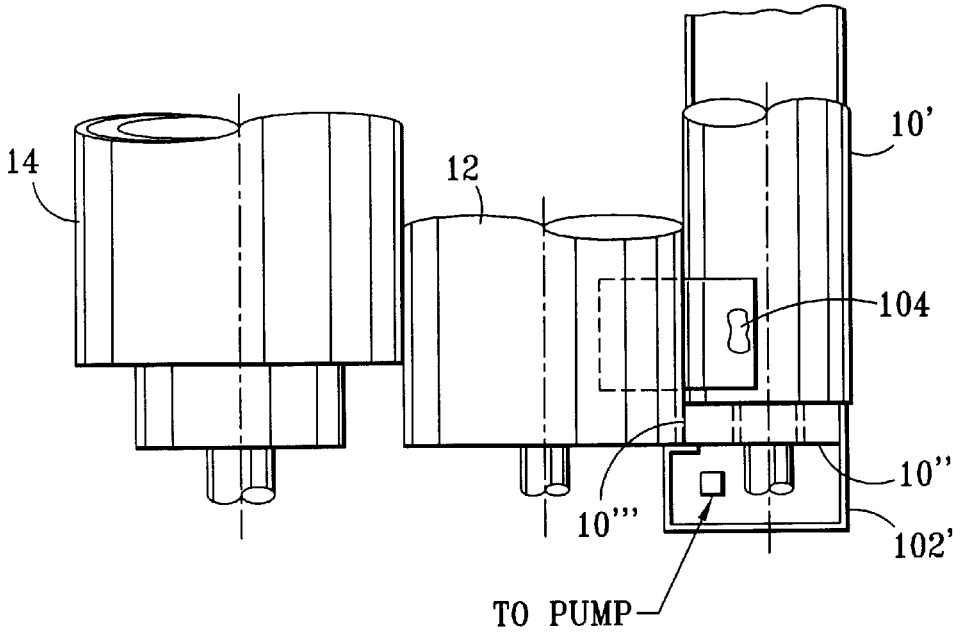
FIG. 10 is a partial sectional view showing the metering roll, transfer roll, and backup roll that corresponds to Section C—C of FIG. 9A.

FIG. 10 is a partial sectional view showing the metering roll, transfer roll, and backup roll that corresponds to Section C—C of FIG. 9A.

One or two sided application of moisture, etc. may also be accomplished by placing a second applicating device with a transfer roll 12, metering roll 10, and backup roll 14 downstream of and somewhat below the first liquid applicating device, and routing sheets 90 in a straight line over and bypassing the second device for moisturizing only one side. When both sides are to be moisturized, the sheets 90 are routed through the first device and then directed in a reversed "S" ( ) curve over and under the backup roll 14 and under the transfer 12 and metering 10 rolls, thereby applying liquid 104 to each side of the sheet 90. Sheet guide means and feed rolls placed at strategic locations propel the sheet to, through, and away from the applicating devices.

Figure 12:
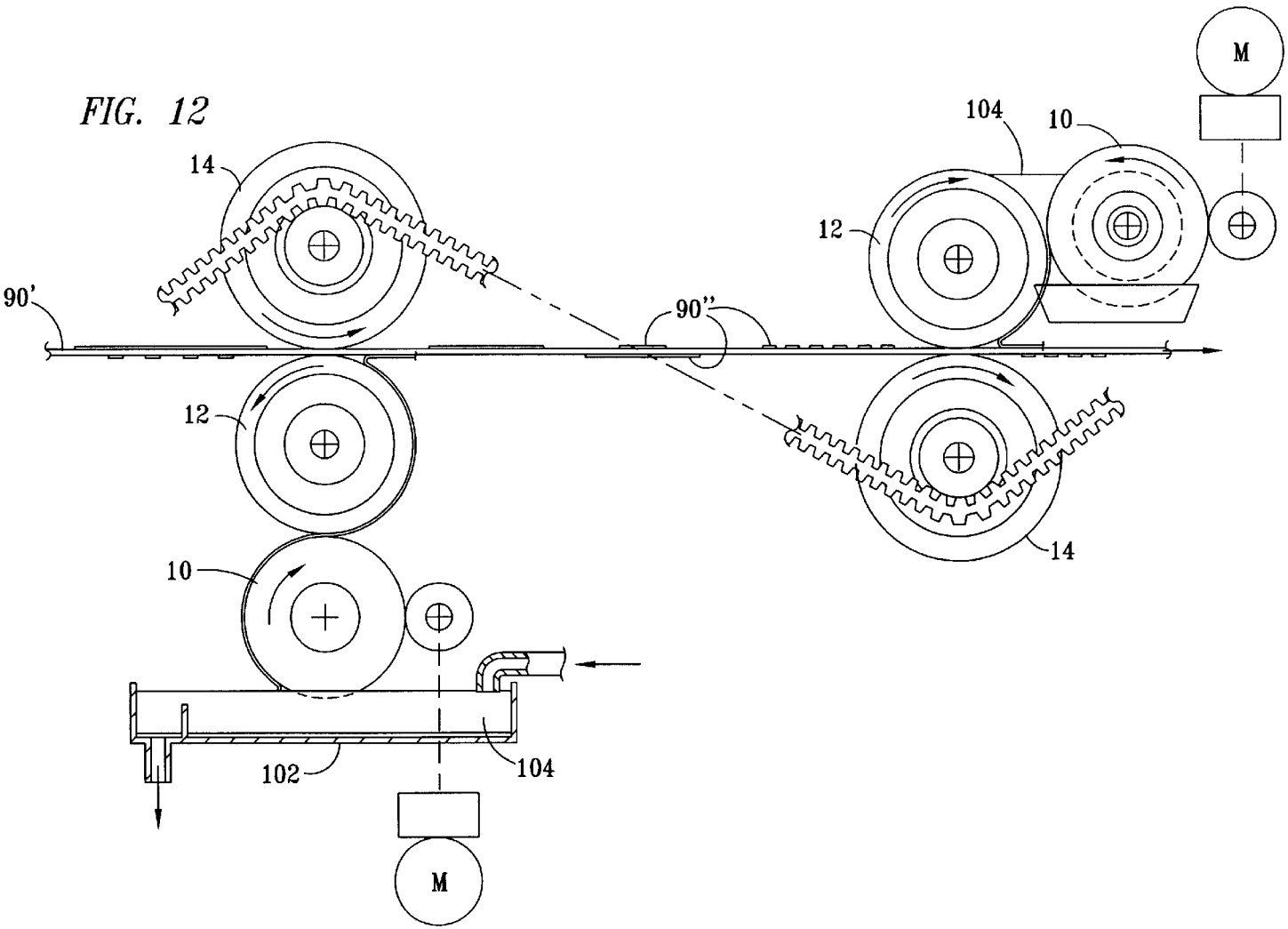
FIG. 12 is a semi-diagrammatic side view showing an imaged substrate progression thru a horizontal moisturizing system containing two moisturizing devices residing on opposite sides of a substrate, whereby the first device moisturizes the bottom surface of the substrate and the second device, residing downstream of the first moisturizing device, moisturizes the top surface of the substrate.

FIG. 12 is a semi-diagrammatic side view showing an imaged substrate (90') progression thru a horizontal moisturizing system. The system contains two moisturizing devices that are similar to the devices described above in FIGS. 3 and 9A. The two devices reside on opposite sides of the imaged substrate (90'). The first device moisturizes the bottom surface of the substrate including any images (90") located on the imaged substrate (90') and the second device resides downstream of the first moisturizing device and moisturizes the top surface portion of the substrate (90').

Figure 11:
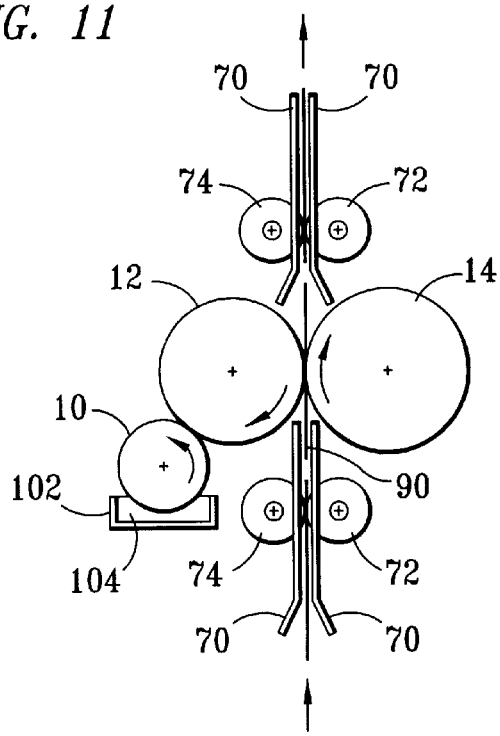
FIG. 11 is a semi-diagrammatic side view showing application of a liquid where sheets travel progressively straight to, through, and away from the system but in a vertical path in lieu of the horizontal path shown in previous figures.

FIG. 11 is a semi-diagrammatic side view showing application of moisture where sheets travel progressively straight to, thru, and away from the system but in a vertical path in lieu of the horizontal path shown in the previous figures. For a two sided application, two units (one as shown and one as an opposite configuration) are placed one above the other.

Figure 13:
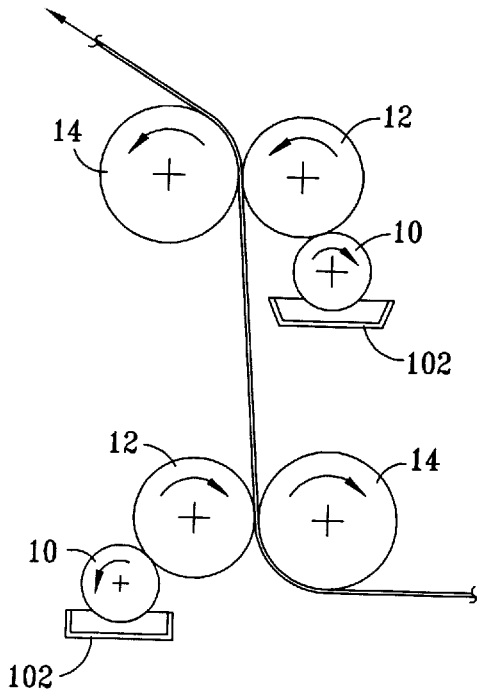
FIG. 13 is a semi-diagrammatic side view showing an imaged substrate progression thru a verticle moisturizing system containing two moisturizing devices residing on opposite sides of a substrate, whereby the first device moisturizes the bottom surface of the substrate and the second device, residing downstream and fixed above the first moisturizing device, moisturizes the top surface of the substrate.

FIG. 13 is a semi-diagrammatic side view showing an imaged substrate (90') progression thru a vertical moisturizing system. The system contains two moisturizing devices that residing on opposite sides of the imaged substrate (90'). The first device moisturizes the bottom surface of the substrate (90') and the second device, residing downstream and fixed above the first moisturizing device, moisturizes the top surface of the substrate (90').

Figure 14:
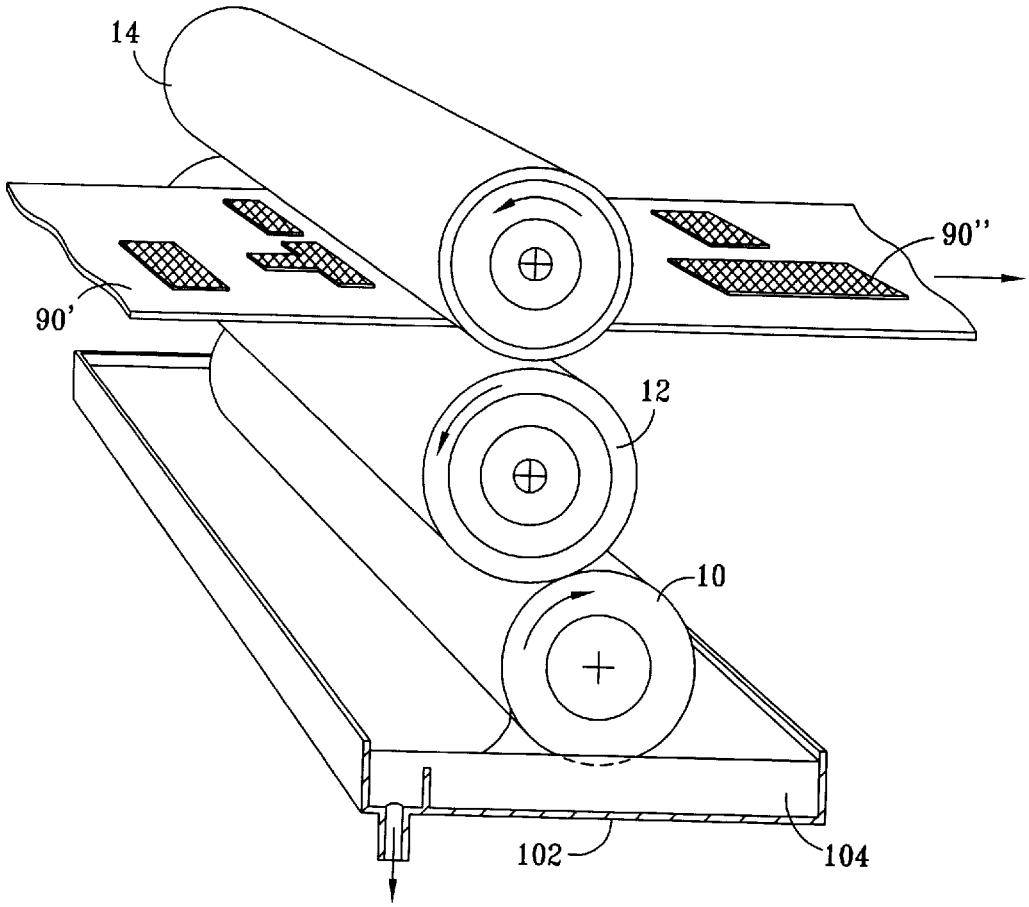
FIG. 14 is a side view of a metering roll, transfer roll, and backup roll of an assembly of the present invention in section showing the progression of an imaged substrate thru the backup roll and transfer roll nip.

FIG. 14 is a side view of a metering roll (10), transfer roll (12), and backup roll (14) of an assembly of the present invention in section showing the progression of an imaged substrate (90') thru the backup roll and transfer roll nip.

It is important to note that FIGS. 2, 3, 5, 6, 7, 8, 9A, 11, 12, 13, and 14 show application of liquid (specifically moisture) where the direction of the surface of the transfer roll 12 opposes that of the direction of sheet flow, i.e., rotates in a direction "opposite" to that of the sheet 90. Conversely, FIG. 9B shows application of liquid (primarily coating) where the direction of rotation of the surface of the transfer roll 12 is in the same direction as that of the sheet flow.

In the system herein described, both the transfer 12 and metering 10 rolls are driven together by positive means. The metering 10 roll rotates in pressure contact with the variable speed transfer roll 12 and is the roll which is adjusted to control the desired metered film of liquid. The metering roll 10 need only be driven at a speed sufficient to produce a continuous metered, substantially constant, liquid film on the transfer roll surface which is transferred to the sheet 90 in the desired quantity, depending upon the adjusted speed of rotation of the transfer roll 12 relative to that of the speed of the sheet 90. An increase in transfer roll 12 speed yields an increase in the amount of liquid applied to the sheet and conversely a decrease in transfer roll 12 speed yields a decrease in the amount of liquid applied.

It is important to note that although the backup roll 14 applies a constant uniform pressure to the sheet, the backup roll 14 and transfer roll 12 do not touch in the space between the sheets as sheets successively progress through the liquid applying system, as will be more fully explained later.

The most popular use of the method and apparatus disclosed herein is for adding and controlling moisture applied to paper and paperboard sheets both off-line or on-line with paper converting equipment. The compact design enables the equipment in many cases to be installed in the normal sheet stream as the paper comes through the converting machine. In the processing of the paper sheet or sheets, the paper is usually depleted of moisture to an extent that a controlled amount of moisture is required to be added thereto. Reasons for desiring controlled liquids is described below.

On paper or paperboard sheet materials, moisture or a mixture of liquids may be added to the paper in controlled quantities to condition same, to control the curl, cockle (tendency to buckle), weight, sizing, absorbency capacity, moldability, gloss, scuff resistance, barrier properties, surface finish, tensile strength, electric and thermal conductivity, ability to receive ink or hold ink, cohesion, adhesion, pH, stress relief (tension), drying, dimensional stability, cosmetic look and feel, and others.

Although the method and device is particularly usable in adding moisture to coated or uncoated paper or paperboard, it will be understood that it can be used to control and apportion the addition of tints, dyes, coating materials, liquid plastics, glue, starch, waxes and other low-viscosity liquids desired to be applied to the surface of a sheet whether pervious or impervious.

The equipment employed is very flexible in that it may be simple or complex depending upon the particular user's requirements. For instance, in one of the simplest and most economical forms it may include the basic elements of positive control of speed of rotation of the transfer roll with relation to the speed of movement of the sheet, control of linear thickness of the moisture film metered between the transfer roll and the metering roll by adjustments at the metering roll ends coupled with fixed or adjustable "skewing"; or the system may incorporate automatic and remotely controlled features which may include means to automatically engage and disengage liquid application to the sheet; automatic increase and decrease following circuitry to maintain desired liquid application to compensate for changes of moisture or changes in sheet speed; automatic shutdown resulting from lack of sufficient liquid supplied to the system, motor overload or sheet jam; electro-pneumatic roll engagement and/or disengagement; remote speed control and indication; servo actuated metering roll or backup roll adjustment; automatic liquid level control in the reservoir and many other types of controls and adjustments. It will be further understood that even though the rolls are referred to as being "hard" and "resilient," these are only relative terms and roll identities could be reversed or could actually be made of the same material such as plastic or rubber elastomers which would be resilient material but the relative hardness might be different. These surfaces could still be adjusted in pressure -relationship to provide for metering and application of a regulated film of liquid.

It will be seen that we have provided means for precisely metering and transferring liquid to moving sheets in regulated quantity and with uniform addition over the entire sheet wherein the amount of moisture or other such liquid may be regulated by varying the speed of rotation of a transfer roll first in contact with a metering roll, wherein the amount of liquid is formed onto the transfer roll in uniform thickness across this roll by metering same between a smooth resilient surfaced roll and a hard surfaced hydrophilic roll, then continuously presenting this metered uniform thickness into contact with successive sheets which are guided and propelled to a backup roll having a resilient and smooth surface such that the backup roll frictionally pulls and moves the sheet in a direction opposite to that of the transfer roll and at the same time provides pressure to a back side of the sheet forcing the sheet to the uniform liquid film supported by the transfer roll, then guiding and propelling the sheet away from the backup roll and transfer roll.

The following examples are introduced to further illustrate the present invention but not with the intention of unduly limiting the same.

EXAMPLE

Moisture Applications Tests

Objective

To penetrate various cut sheets of paper/paperboard and coated and uncoated substrates with controlled amount of water addition.

Consideration For Moisture Systems Are

1. Two or more rubber rolls running in line direction as substrate passes between rolls for moisture pickup.

2. Rubber rolls, one running in a direction opposite of the direction of the substrate.

3. Hydrophilic/chrome transfer roll running in reverse of substrate in tandem with a rubber backup roll. Rubber backup roll running in sheet direction.

Objective to Above

1. Rubber to rubber rolls in same direction as substrate direction does not produce even penetration to the moving material. Water built up between rolls can and does cause build up of hydrodynamic wedge pressure giving rise to spotty excessive water into sheet. Texturing rolls allows water to go thru nip but pressure is the only variable to change moisture control.

2. Standard non-hydrophilic rubber roll running in reverse has the same tendency as above to build up excessive amount of water pressure at various times and deliver same to sheet causing excessive moisture penetration at intermittent intervals.

3. Hydrophilic chrome roll would cause sheet as being fed into the roller to buckle and cause jams.

Machine Experimentations

The first consideration was to prove or disprove the reverse roll system as a viable tool for moisturizing a sheet fed system. The main concern of course, was getting a sheet to feed into a nip with one roll running against the flow of the sheet. For example, on web fed equipment the web is always under tension and running before the reverse roll is set in motion, allowing the reverse roll to run because of water acting as a lubricant.

Another consideration to overcome was the stripe (pressure surface between rubber roll and hydrophilic roll). It was believed before testing that we could not allow the rubber backup roll and hydrophilic roll to touch, but must be a kiss only. Various pressures were used and we concluded that a tight nip pressure on the sheet between the two rolls is required, using paper as the measuring tool to set the gap.

The paper gauge was 0.004", using a medium pull pressure. This allowed the use of a variety of thicknesses to be run. As the thickness increases, the rubber backup roll will conform to the added height. We estimated that the nip gap was about 0.002". The two rolls, one wet and one dry, must not touch each other for two main reasons: (a) on start-up the backup roll strips all the water from the chrome roll, having two dry surfaces to run opposite to each other with no lubrication to allow a sheet to pass between the two rolls; and (b) chrome roll transfers water to backup roll and then to the back side of the sheet, or to subsequent sheets.

Paper Used Was

1. Alling and Cory, 0.0035".

2. Cougar Opaque, 0.0045" short grain (coated two sides).

3. Lustrogloss, 0.004" (80# text, Long grain, coated two sides).

4. Computed Copy, 0.004" (laser/copy paper, long grain sub 20).

Conclustions to Machine Experimentation

We can successfully run sheets in single fashion through a reverse roll system. We can successfully add controlled quantities of moisture to the sheets and can control the sheet as it passes into and through and out of the moisturizer system. (Therefore, no sheet buckles or sheet kickbacks was experienced on all the test runs.)

Moisture Penetration Testing

After determining proper nip setting it was now time to determine roll speeds for various moisture amounts on various sheet types and thicknesses.

Originally it was thought speeds of 2.5 to 3.5 times faster than line speed would be needed. Testing showed that 1.75 to 2.5 times line speed was needed. It should be noted that in all trials, except one, sheets were at room temperature.

Our first trials consisted of what we considered a challenge sheet. It was a sheet of 11½"×8" paper with a black image approximately 6½"×3½" placed on the center of the sheet.

The challenge sheet was run:

1. a) Print side up at 200 fpm reverse roll speed and 100 fpm line speed. Water addition was 2.30%.

b) Print side down run at same speed. Water addition was 2.49%.

2. a) Print side up, same as above. Water addition was 2.47%.

b) Print side down, same as above. Water addition was 2.56%.

Satisfied that we were able to apply moisture to this sheet, we started experimentation on copier paper with no imaging. Plain copier paper at 100 fpm line speed and 100 fpm reverse roll speed showed insignificant moisture penetration. Increasing the reverse roll to 200 fpm gave a 2.6% addition to the base sheet. The second pass moisturizing the opposite side added an additional 1.9% of water. At 250 fpm reverse roll speed, 3.4% was added to the base sheet and passing through for the opposite side we gained 2.5% addition. A line speed of 100 fpm was the basis for all tests. Only the hydrophilic reverse transfer roll speeds were changed.

Testing Customer Supplier Paper

1. Alling and Cory

One pass at 200 fpm reverse roll yields 1.74% add on, on first pass and additional 1.4% on second pass. At 250 fpm, first pass 2.33% add on and an additional 1.9% on second pass.

2. Cougar Opaque

At 200 fpm gave 1.97% add on and an additional 1.6% on second pass.

3. Lustrogloss

At 300 fpm 3.7% and 2.96%.

All testing showed that for best curl control, imaged side should be moisturized first, unprinted side second.

One test of particular interest was running a hot sheet through for moisturization. Thirty sheets were run off a copier wrapped in a corrugated flat sleeve and taken to the moisturizing unit. A sheet from the center was pulled and weighed and moisturized at 200 fpm reverse roll speed. Printed side moisturized first showed 2.4% add on and unprinted moisturing gave 2.4%. It should also be noted here that one sample was removed from the center of the hot sheets, weighed and left to pick up moisture to equilibrium. Moisture pick up was 2.7%.

Reverse Roll Speeds and Percentage Water Addition

1. Ailing and Cory sheets

A. 200 fpm yielded approx. 2.0% add on.

B. 250 fpm yielded approx. 2.3% add on.

C. 250 fpm yielded approx. 2.7% add on.

D. 300 fpm yielded approx. 3.5% add on.

2. Cougar Opaque

A. 150 fpm yielded approx. 0.6% add on.

B. 200 fpm yielded approx. 2.0% add on.

C. 250 fpm yielded approx. 2.5% add on.

D. 300 fpm yielded approx. 3.5% add on.

3. Lustrogloss

A. 200 fpm yielded approx. 1.6% add on.

B. 250 fpm yielded approx. 2.4% add on.

C. 275 fpm yielded approx. 3.1% add on.

D. 300 fpm yielded approx. 3.7% add on.

NOTE: Curves plotted from above test data indicates similarities between the three (3) sheet types tested, especially numbers 2 and 3. The slopes of curves were practically the same, showing an approximate 1% increase in moisture per 50 fpm increase in speed.

Other Testing

Running sheet lengthwise or width-wise showed no difference in moisture as far as moisture acceptance or curl. Using a colored dye did show peaks and valleys on uncoated papers. Use of colored dye was also used to see if a pattern was transmitted from chrome roll to following sheet. There was no ghosting or pattern transmission on an interrupted web, that is, a web having cutouts along the web length.

Nip Pressure vs. Paper Thickness

Because the caliper of the papers ran were very close in thicknesses, we decided to explore what would be the effect to % of moisture addition on thicker papers. Due to our limited supply of paper grades, we improvised by using two sheets or three sheets as one.

The percent moisture would decrease as thickness increased, i.e. 0.004" paper at 200 fpm chrome roll speed produces about 2.0% add on while two 0.004" papers (=0.008") run at 200 fpm produced about 0.98% add on. In order to reach the 2.0% add on level, the chrome roll speed has to be increased to approximately 300 fpm. (Actually, the "add on" percent was the same regardless of sheet thickness or pressure increase from the backup roll.)

Summary

It is possible to run paper/paperboard sheets through a reverse hydrophilic chrome roll nip. Control of moisture add on can be maintained by a constant nip setting (gap) and controlled chrome roll speed. Altering the chrome roll speed faster increases the percent add on, while decreasing the chrome roll speed decreases the percent moisture add on. Nip setting for 0.004" paper will take a range of paper thickness from 0.003" to 0.012", and maybe more. No ghosting, streaks, patterning, or smudging, etc. was apparent at intermittent sheet feeding. Any size paper that will accept moisture can be fed into the nip and be moisturized. Moisturization control is obtained and controlled if sheet is fed length or widthwise.

Addendum to Moisture Testing

Upon completion of testing with water, we used a water-based acrylic coating having a makeup of approximately 55% water and 45% solids and a viscosity of 150–175 centipoise. (Water is 1.0 centipoise.) The chrome transfer roll was run with the sheet flow direction (the opposite as that for water), and at the same surface speed until the metering roll was tightened, the viscosity reduced, transfer roll speed reduced, and pressure increased (by adding another sheet). We did not obtain acceptable coated sheets; basically, too much coating and streaks. After making the above mentioned changes, we achieved very good coating quality, although there was a small uncoated area along the leading edge of each sheet, indicating that the leading edge of the sheet was pushing the coating ahead when the transfer roll was slower than sheet speed; until the sheet was lifted and the coating passed under the sheet. By slightly readjusting the machine and/or coating, it was found that a 100% coated sheet could be obtained by running a transfer roll at sheet speed, or slightly higher.

Although the present invention and its advantages have been described in detail, it should be understood that various changes, substitutions and alterations can be made herein without departing from the spirit and scope of the invention as defined by the appended claims.

What is claimed is:

1. A moisturizing device for applying a quantity of liquid to a substrate comprising:

a first roll having a resilient dry surface for contacting a first side of said substrate;

a second roll disposed substantially adjacent to the first roll and having a hydrophilic surface for carrying an uninterrupted uniform film of liquid to a second side of the substrate, wherein the surface of the first roll and the surface of the second roll simultaneously apply substantially uniform pressure to the first and second sides of the substrate as the substrate moves between the first and second rolls;

means for rotating the rolls relative to each other;

means for feeding and guiding the substrate into a first cusp formed by the surfaces of the rolls for enabling the resilient dry surface of the first roll to frictionally move with the substrate between the first and second rolls at a predetermined line speed, wherein the surface of the second roll is for continuously applying the uniform film of liquid over substantially the entire second side of the substrate; and means for spacing the roll surfaces during the absence of the substrate passing between the rolls;

means for guiding the substrate exiting from a second cusp formed by the surfaces of the first and second rolls.

2. The moisturizing device of claim 1, wherein the said device includes a means for rotating the rolls independently of each other.

3. The moisturizing device of claim 1, wherein the surface of the second roll rotates in a direction opposite to that of the substrate moving between the rolls.

4. The moisturizing device of claim 3, wherein an abundant supply of liquid is made constantly present at a metering member and the second roll surface, immediately before the liquid film is formed on the surface of the second roll.

5. The moisturizing device of claim 4, wherein the metering member is a third roll.

6. The moisturizing device of claim 5, wherein the third roll ha s a surface that is in indented pressure relation with the surface of the second roll.

7. The moisturizing device of claim 1, wherein the uniform film of liquid carried by the surface of the second roll is formed by a metering member in pressure relation with the surface of the second roll.

8. The moisturizing device of claim 1, wherein the substrate is in the form of a cut sheet.

9. The moisturizing device of claim 1, wherein the substrate is an imaged substrate.

10. The moisturizing device of claim 1, wherein the substrate is in the form of a web.

11. A moisturizing system containing a plurality of moisturizing devices, as defined in claim 1, residing on opposite sides of a substrate, and working in sequence to control the curl of a substrate, each applying a preselected quantity of a liquid to at least one side of the substrate received into the system comprising;

a first moisturizing device having a first roll and a second roll for carrying an uninterrupted uniform film of liquid to a second side of the substrate;

a means for feeding and guiding the substrate into the first moisturizing device;

a means for guiding the substrate from the first moisturizing device to a second moisturizing device, the second moisturizing device having a first roll and a second roll for carrying an uninterrupted uniform film of liquid to a first side of said substrate; and a means for guiding the substrate away from the second moisturizing device.

12. The moisturizing device of claim 11, wherein the substrate is an imaged substrate.

13. The moisturizing device of claim 12, wherein the image on the substrate is formed by a toner.

14. The moisturizing system of claim 11, wherein the surface of the first roll is a resilient elastomer material.

15. The moisturizing system of claim 14, wherein the resilient surface of the first roll applies pressure to the substrate as the substrate moves between the first and the second rolls.

16. The moisturizing system of claim 14, wherein the resilient elastomer surface is compressible and is compressed as the substrate passes between the surfaces of the rolls to enable the uniform film of liquid to be applied substantially uniformly.

17. The moisturizing system of claim 11, wherein the surface of the second roll has a hydrophilic surface.

18. The moisturizing system of claim 11, wherein the means for feeding and guiding the substrate comprises a feed roll means in contact with opposite sides of the substrate to feed the substrate, and a spaced flat guide plate adjacent each side of the substrate, to guide the substrate to enter a cusp formed between the first and second rolls.

19. The moisturizing system of claim 11, wherein the surface of the second roll rotates in a direction opposite to that of the substrate moving between the rolls.

20. The moisturizing system of claim 11, wherein the substrate is in the form of a cut sheet.

21. The moisturizing system of claim 11, wherein the substrate is in the form of a web.

22. A moisturizing system containing a plurality of moisturizing devices residing on opposite sides of a substrate, each applying a preselected quantity of a liquid to at least one side of the substrate received into the system, each device comprising:

a first roll having a resilient dry surface for contacting a first side of said substrate;

a second roll disposed substantially adjacent to the first roll and having a hydrophilic surface for carrying an uninterrupted uniform film of liquid to a second side of the substrate, wherein the surface of the first roll and the surface of the second roll simultaneously apply substantially uniform pressure to the first and second sides of the substrate as the substrate moves between the first and second rolls;

a third metering roll disposed substantially adjacent to the second roll, having a surface for carrying an abundant supply of liquid to a cusp formed by the surface of the metering roll and the surface of the second roll, wherein the uniform liquid film carried by the surface of the second roll is formed by the metering member in pressure relationship with the surface of the second roll;

means for feeding the substrate between the first and second rolls, for enabling the resilient dry surface of the first roll to frictionally move the substrate between the first and second rolls at a predetermined line speed;

the hydrophilic surface of the second roll applying a portion of the film at a rate sufficient to continuously apply liquid over substantially the entire second side of the substrate;

means for guiding the substrate exiting from a position between the surfaces of the first and second rolls;

means for rotating the rolls relative to each other; and means for spacing the roll surfaces during the absence of the substance passing between the rolls.

23. The moisturizing system of claim 22, wherein the substrate is an imaged substrate.

24. The moisturizing system of claim 22, wherein the surface of the second roll of each of the moisturizing devices rotate in a direction opposite to that of the substrate moving between the rolls.

25. The moisturizing system of claim 22, wherein an end seal for containing liquid is connected to the metering member of at least one of the moisturizing devices to contain liquid between said metering member and the surface of the second roll.

26. The moisturizing system of claim 22, wherein an end seal for containing liquid is connected to the second roll of at least one of the moisturizing devices to contain liquid between said metering member and the surface of the second roll.

27. The moisturizing system of claim 22, wherein the substrate is partially depleted of moisture prior to entering the system.

28. The moisturizing system of claim 22, wherein the substrate is in the form of a cut sheet.

29. The moisturizing system of claim 22, wherein the substrate is in the form of a web.

30. The moisturizing System of claim 22, wherein the plurality of moisturizing devices work in sequence to control curl of the substrate.

31. Method for applying a preselected quantity of liquid from a plurality of moisturizing devices to at least one side of a substrate comprising the steps of:

feeding the substrate into a cusp formed by a friction surface of a first roll and a liquid-carrying surface of a second roll of a first device, said liquid-carrying surface carrying an uninterrupted uniform film of liquid;

rotating the first roll of the first device relative to the second roll of the first device to enable the friction surface of the first roll to move with the substrate between the first and second rolls at a predetermined line speed;

contacting a selected first side of the substrate with the liquid-carrying surface of the second roll of the first device to continuously apply a preselected quantity of liquid over substantially the entire selected first side of the substrate;

guiding the substrate into a cusp formed by a fiction surface of a first roll and a liquid-carrying surface of a second roll of a second device, said liquid-carrying surface carrying an uninterrupted uniform film of liquid;

rotating the first roll of the second device relative to the second roll of the second device to enable the friction surface of the first roll to move with the substrate between the first and second rolls at a predetermined line speed; contacting a second side of the substrate with the liquid-carrying surface of the second roll of the second device to continuously apply a preselected quantity of liquid over substantially the entire second side of the substrate; guiding the substrate on exiting from the cusp of the second device; and spacing the roll surfaces during an absence of the substrate passing between the rolls.

32. The Method of claim 31 further comprising a substrate that is an imaged substrate.

33. The Method of claim 31 further comprising a substrate that is made of a cut sheet.

34. The method of claim 31 further comprising a substrate that is made of a web.

35. The Method of claim 31 further comprising a space between the roll surfaces during an absence of the substrate passing between the rolls, said space extending beyond the substrate along the length of the rolls.

36. A system for controlling curl in a paper substrate having images formed thereon, by a toner, by applying a preselected continuous controllable quantity of moisture to select sides of said substrate by passing the imaged paper substrate between two adjacent rotatable rolls in each of two in-line moisture applying devices positioned to apply moisture to opposite sides of the substrate, each device comprising:

a first roll having a resilient dry surface for contacting a first side of the imaged substrate;

a second roll having a hydrophilic surface for carrying an uninterrupted uniform film of moisture to a second select side of the imaged substrate, wherein the resilient surface of the first roll and the hydrophilic surface of the second roll simultaneously apply substantially uniform pressure to the first and second sides of the imaged substrate as the substrate moves between the first and second rolls, said roll surfaces extending beyond the substrate passing between the rolls;

wherein the uniform film of moisture carried by the surface of the second roll is formed by a metering member applying pressure to the surface of the second roll;

means for providing a substantially constant supply of water to the metering member immediately before the liquid film is formed on the surface of the second roll;

means for presenting the paper substrate having images formed thereon by a toner between the first and second rolls to each device and through and out of each device for enabling the resilient surface of the first roll to apply pressure to the imaged substrate as the substrate moves between the first and second rolls, and enabling the surface of the second roll to apply a portion of the film at a rate sufficient to continuously apply the preselected continuous controllable quantity of liquid over substantially the entire second select side of the imaged substrate;

means to rotate the surface of the second roll in a direction opposite to that of the surface of the first roll and that of the imaged substrate;

means for rotating the rolls relative to each other; and means for establishing clearance between the first and second roll surfaces extending beyond the imaged substrate passing between the rolls.

37. The system according to claim 36, wherein at least one of the moisturizing devices includes a plurality of end seals for containing water between the ends of the second roll and the metering member.

38. A system according to claim 36, wherein the metering member is a third metering roll and the surface of the roll is skewed relative to the surface of the second roll.

39. A system according to claim 37, wherein the metering member is a third metering roll and the surface of the roll is skewed relative to the surface of the second roll.

40. The system of claim 36, wherein the paper substrate having images formed thereon has been partially depleted of moisture prior to entering the system.

41. The system of claim 40, wherein the imaged paper substrate passing though the system is in the form of cut sheers.

42. The system of claim 40, wherein the imaged paper substrate passing through the system is in the form of a continuous web.

43. The system of claim 36, wherein the imaged paper substrate passing through the system is in the form of cut sheets.

44. The system of claim 36, wherein the imaged paper substrate passing through the system is in the form of a continuous web.

45. A method for controlling curl in a paper substrate having images formed thereon by a toner, by applying a preselected continuous controllable quantity of moisture to select sides of said substrate by passing the imaged paper substrate between two adjacent rotatable rolls in each of two in-line moisture applying devices positioned to apply moisture to opposite sides of the substrate, comprising:

providing each moisture applying device a first roll having a resilient dry surface contacting a first side of the imaged substrate;

providing each moisture applying device a second roll having a hydrophilic surface carrying an uninterrupted uniform film of moisture to a second select side of the imaged substrate, wherein the resilient surface of the first roll and the hydrophilic surface of the second roll simultaneously apply substantially uniform pressure to the first and second sides of the imaged substrate as the substrate moves between the first and second rolls, said roll surfaces extending beyond the substrate passing between the rolls;

providing a metering member forming the uniform film of moisture carried by the surface of the second roll applying pressure to the surface of the second roll;

providing a substantially constant supply of water to the metering member immediately before the liquid film is formed on the surface of the second roll;

presenting the paper substrate having images formed thereon by a toner between the first and second rolls of each device and through and out of each device for enabling the resilient surface of the first roll to apply pressure to the imaged substrate as the substrate moves between the first and second rolls, and enabling the surface of the second roll to apply a portion of the film at a rate sufficient to continuously apply the preselected continuous controllable quantity of liquid over substantially the entire second select side of the imaged substrate;

rotating the surface of the second roll in a direction opposite to that of the surface of the first roll and that of the imaged substrate;

rotating the rolls relative to each other; and establishing clearance between the first and second roll surfaces extending beyond the imaged substrate passing between the rolls.

46. The method as defined by claim 45, which further comprises providing a plurality of end seals containing a liquid between the end of the second roll and a metering member.

47. The method as defined by claim 46, which further comprises the step of providing the metering member having a surface skewed relative to the surface of the second roll.

48. The method as defined by claim 45, which further comprises the step of providing the metering member having a surface skewed relative to the surface of the second roll.

49. The method as defined by claim 45, which further comprises the step of depleting the moisture on the paper substrate prior to the imaged substrate entering the first device.

50. The method as defined by claim 49, which further comprises the step of providing the imaged paper substrate passing through the system in the form of cut sheets.

51. The method as defined by claim 49, which further comprises the step of providing the imaged paper substrate passing through the system in the form of a continuous web.

52. The method as defined by claim 45, which further comprises the step of providing the imaged paper substrate passing through the system in the form of cut sheets.

53. The method as defined by claim 45, which further comprises the step of providing the imaged paper substrate passing through the system in the form of a continuous web.

* * * * *

UNITED STATES PATENT AND TRADEMARK OFFICE

CERTIFICATE OF CORRECTION

PATENT NO. : 6,176,180 B1
DATED : January 23, 2001
INVENTOR(S) : Taylor et al.

It is certified that error appears in the above-identified patent and that said Letters Patent is hereby corrected as shown below:

Column 2,
Line 44, delete "ally" and insert -- graphically --

Column 8,
Line 22, delete "$f_{BU/R}$," and insert -- $n_{BU/R}$, --
Line 44, delete "$f_{T/R}$="

Column 11,
Line 15, delete "-relationship" and insert -- relationship --

Column 13,
Line 19, delete "Supplier" and insert -- Supplied --
Line 48, delete "Ailing" and insert -- Alling --
Line 51, delete "250" and insert -- 275 --

Column 15,
Line 43, delete "ha s" and insert -- has --

Column 17,
Line 5, delete "substance" and insert -- substrate --
Line 40, delete "fiction" and insert -- friction --

Signed and Sealed this

First Day of January, 2002

*Attest:*

*Attesting Officer*

JAMES E. ROGAN
*Director of the United States Patent and Trademark Office*